US007289064B2

(12) United States Patent
Cheng

(10) Patent No.: US 7,289,064 B2
(45) Date of Patent: Oct. 30, 2007

(54) COMPACT MULTI-BAND, MULTI-PORT ANTENNA

(75) Inventor: Dajun Cheng, Marlborough, MA (US)

(73) Assignee: Intel Corporation, Santa Clara, CA (US)

( * ) Notice: Subject to any disclaimer, the term of this patent is extended or adjusted under 35 U.S.C. 154(b) by 149 days.

(21) Appl. No.: 11/209,218

(22) Filed: Aug. 23, 2005

(65) Prior Publication Data

US 2007/0052587 A1 Mar. 8, 2007

(51) Int. Cl.
*H01Q 1/38* (2006.01)

(52) U.S. Cl. ..... 343/700 MS; 343/846

(58) Field of Classification Search ..... 343/700 MS, 343/713, 846, 848
See application file for complete search history.

(56) References Cited

U.S. PATENT DOCUMENTS 4,356,492 A 10/1982 Kaloi
5,548,297 A * 8/1996 Arai ..... 343/700 MS
5,714,961 A * 2/1998 Kot et al. ..... 343/769
5,828,342 A 10/1998 Hayes et al.
5,914,694 A 6/1999 Raab
6,184,828 B1 * 2/2001 Shoki ..... 342/372
6,252,559 B1 6/2001 Donn
6,597,316 B2 * 7/2003 Rao et al. ..... 343/700 MS
6,670,923 B1 12/2003 Kadambi et al.
6,717,554 B1 4/2004 Ming
6,870,507 B2 3/2005 Anguera Pros et al.
2003/0210193 A1 11/2003 Rossman

OTHER PUBLICATIONS

Rao, Basrur R., et al., "GPS Microstrip Antenna Array on a Resistivity Tapered Ground Plane for Multipath Mitigation", [http:www.mitre.org/work/tech_papers_00/rao_microstrip/], (2000),9 pages.

* cited by examiner

*Primary Examiner*—Hoanganh Le
(74) *Attorney, Agent, or Firm*—The Law Offices of John C. Scott LLP; John C. Scott

(57) ABSTRACT

A multi-band, multi-port antenna includes at least one patch radiating element and at least one ring radiating element, that are operative within different frequency bands, on a common conductive layer.

42 Claims, 7 Drawing Sheets

COMPACT MULTI-BAND, MULTI-PORT ANTENNA

TECHNICAL FIELD

The invention relates generally to antennas and, more particularly, to compact antennas that are capable of simultaneous operation within multiple frequency bands.

BACKGROUND OF THE INVENTION

Many wireless devices, systems, and components exist and are being developed that are capable of operation within multiple frequency bands. For example, devices such as cellular telephones, personal digital assistants (PDAs), portable computers, and others may include cellular telephone functionality that is operative within one frequency band, wireless networking functionality that is operative within another frequency band, and Global Positioning System (GPS) functionality that is operative within yet another frequency band, all within a single device. Typically, a different antenna would be used for each function. However, the use of multiple separate antennas within a device can require a large amount of space. In many devices, it is desirable to use components that are smaller in size so that the overall size of the device may be reduced and/or so that more room is available for additional functionality. There is a need for compact antenna structures that are capable of servicing multiple different frequency bands within a limited amount of space.

DETAILED DESCRIPTION

Figure 1:
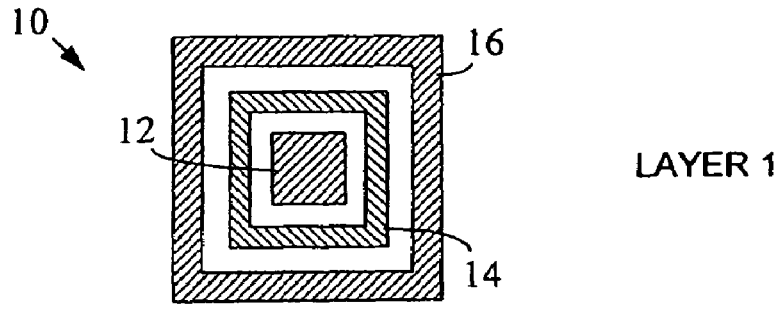
FIGS. 1, 2, 3, 4, 5, and 6 are top views illustrating the various metal layers of an example multi-band, multi-port antenna in accordance with an embodiment of the present invention.

In the following detailed description, reference is made to the accompanying drawings that show, by way of illustration, specific embodiments in which the invention may be practiced. These embodiments are described in sufficient detail to enable those skilled in the art to practice the invention. It is to be understood that the various embodiments of the invention, although different, are not necessarily mutually exclusive. For example, a particular feature, structure, or characteristic described herein in connection with one embodiment may be implemented within other embodiments without departing from the spirit and scope of the invention. In addition, it is to be understood that the location or arrangement of individual elements within each disclosed embodiment may be modified without departing from the spirit and scope of the invention. The following detailed description is, therefore, not to be taken in a limiting sense, and the scope of the present invention is defined only by the appended claims, appropriately interpreted, along with the full range of equivalents to which the claims are entitled. In the drawings, like numerals refer to the same or similar functionality throughout the several views.

The present invention relates to a multi-band, multi-port antenna structure that is capable of being implemented in a relatively compact manner. The antenna structure is comprised of a number of conductive layers and may be used in a variety of different multi-band applications. In at least one application, the antenna structure is used in a portable communication device to provide antenna transmit and/or receive functions in multiple different frequency bands while consuming a relatively small amount of space within the device.

FIGS. 1-6 are top views illustrating the various metal layers 10, 20, 30, 40, 60, 80 of an example multi-band, multi-port antenna in accordance with an embodiment of the present invention. In the completed antenna, the various metal layers 10, 20, 30, 40, 60, 80 are stacked one above the other, with a layer of dielectric material between each successive pair of metal layers. That is, the first metal layer 10 of FIG. 1 is above the second metal layer 20 of FIG. 2, which is above the third metal layer 30 of FIG. 3, and so on. As will be described in greater detail, the second metal layer 20 of FIG. 2 includes a number of radiating elements 22, 24, 26 that are each operative within a different frequency band. Each of these radiating elements 22, 24, 26 has an associated feed structure to act as a feed for the element and, therefore, these elements 22, 24, 26 will be referred to herein as "fed" elements. The first metal layer 10 of FIG. 1 includes a number of "parasitic" radiating elements 12, 14, 16 that do not have associated feed structures. In the illustrated embodiment, each of the parasitic radiating elements 12, 14, 16 corresponds to one of the fed radiating elements 22, 24, 26 on the second metal layer 20. The third metal layer 30 of FIG. 3 includes a ground plane 32 for the various radiating elements of the antenna. The fourth, fifth, and sixth metal layers 40, 60, 80 of FIGS. 4, 5, and 6 include transmission line structures for use in feeding the fed elements of the second metal layer 20. The multi-band, multi-port antenna of FIGS. 1-6 is capable of operating in three different frequency bands simultaneously within a single antenna aperture. In other embodiments, a different number of frequency bands may be supported (i.e., two or more).

Figure 2:
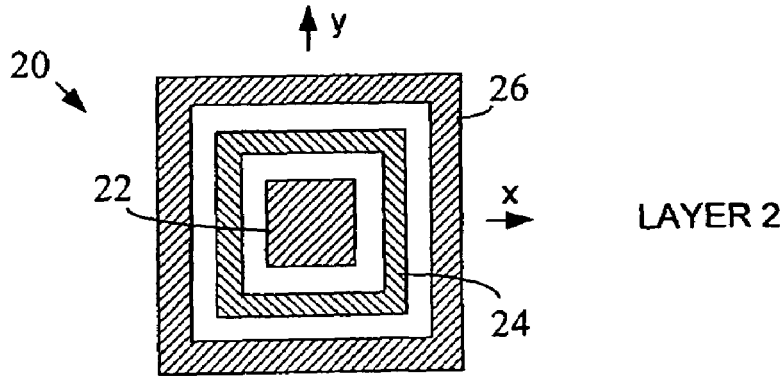

FIG. 2 illustrates the layout of the second metal layer 20 of the multi-band, multi-port antenna in accordance with an embodiment of the invention. As shown, the second metal layer 20 includes: a patch radiating element 22, a first ring radiating element 24, and a second ring radiating element 26 lying in a common plane. As described above, the patch radiating element 22, the first ring radiating element 24, and the second ring radiating element 26 of the second metal layer 20 are each fed elements. That is, each of these elements 22, 24, 26 has a feed structure associated with it that feeds the element during transmit and/or receive operations in a corresponding frequency band. The first ring radiating element 24 surrounds the patch radiating element 22 and the second ring radiating element 26 surrounds the first ring radiating element 24. Each of these radiating elements 22, 24, 26 is adapted for use within a different frequency band from the others. As is well known, the operational frequency range of a patch radiating element and a ring radiating element are typically related to the physical size of the structures (although other factors may also effect the operational frequency range). In at least one embodiment of the present invention, some or all of the fed radiating elements in an antenna are made smaller than would typically be required for the corresponding bands by loading the elements with resistance and capacitance or by using short circuits. In other embodiments, element loading is not used.

Due to its smaller size, the patch radiating element 22 will typically support the highest frequency band serviced by the multi-band, multi-port antenna. Each successive ring radiating element 24, 26 in the antenna (in the outward direction from the patch) will typically support a successively lower frequency band. Any number of fed ring radiating elements (i.e., one or more) may be used in other embodiments. The number used will typically depend upon the number of frequency bands to be supported by an antenna. Additional feed networks can be provided if additional rings are added. Additional metal layers may be added to support the additional feed networks. As illustrated in FIG. 2, in at least one embodiment, the fed radiating elements 22, 24, 26 are each symmetrical about two orthogonal axes (e.g., an x-axis and a y-axis in a Cartesian coordinate system) within the plane of the corresponding metal layer 20.

To improve the operational bandwidth of each of the fed radiating elements 22, 24, 26 on the second metal layer 20, a corresponding parasitic radiating element may be added to the antenna structure. FIG. 1 illustrates the first metal layer 10 of the example multi-band, multi-port antenna that includes a parasitic radiating element for each of the driven elements 22, 24, 26 of the second layer 20 in accordance with an embodiment of the present invention. That is, the first metal layer 10 includes a parasitic patch radiating element 12 that corresponds to the fed patch radiating element 22, a first parasitic ring radiating element 14 that corresponds to the first fed ring radiating element 24, and a second parasitic ring radiating element 16 that corresponds to the second fed ring radiating element 26. Each of the parasitic radiating elements 12, 14, 16 on the first metal layer 10 radiate signals based on currents induced within the elements as a result of radiation from the corresponding fed element. Typically, the overall effect of the parasitic radiating elements 12, 14, 16 is to improve the operational bandwidths of the corresponding fed radiating elements. In some embodiments of the invention, parasitic radiating elements are not used. In other embodiments, some of the fed radiating elements have corresponding parasitic elements, while others do not.

In at least one embodiment of the present invention, the parasitic radiating elements 12, 14, 16 on the first metal layer 10 will be vertically aligned with the corresponding fed radiating elements 22, 24, 26 on the second metal layer 20 in the finished antenna. That is, the center of each of the parasitic radiating elements 12, 14, 16 may be substantially aligned with the center of the corresponding fed radiating element 22, 24, 26 in a direction normal to the plane of the second metal layer 20. In addition, the physical dimensions of the parasitic radiating elements 12, 14, 16 may be different from the dimensions of the corresponding fed radiating elements 22, 24, 26. Typically, the parasitic radiating elements 12, 14, 16 will be smaller than the corresponding fed radiating elements 22, 24, 26 based on the smaller effective wavelength on the first metal layer 10.

Figure 3:
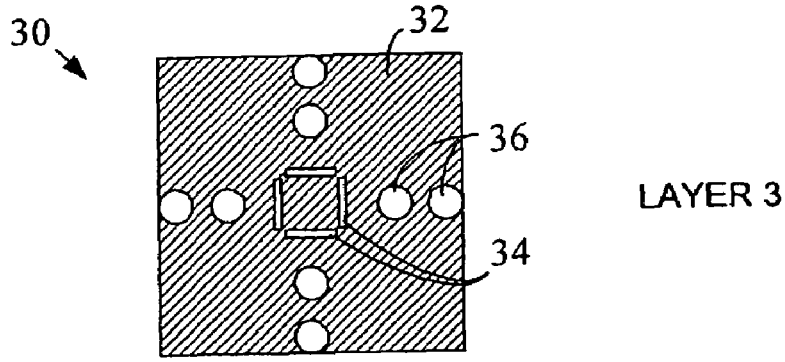

FIG. 3 illustrates the layout of the third metal layer 30 of the example multi-band, multi-port antenna in accordance with an embodiment of the invention. As described previously, the third metal layer 30 includes a ground plane 32 that is spaced from the fed radiating elements 22, 24, 26 of FIG. 2 by a layer of dielectric material. As shown in FIG. 3, the ground plane 32 includes a plurality of slots 34 that may be used to slot feed the patch radiating element 22 of FIG. 2. The ground plane 32 also includes a plurality of openings 36 to allow feed probes to pass through the ground plane 32 from the feed transmission line structures on the fifth and sixth metal layers 60, 80 below. In at least one embodiment of the present invention, all microstrip lines that are used to feed the fed radiating elements on the second metal layer 20 are located on an opposite side of the ground plane 32 from the fed radiating elements to reduce undesired coupling between the microstrip lines and the radiating elements.

Figure 4:
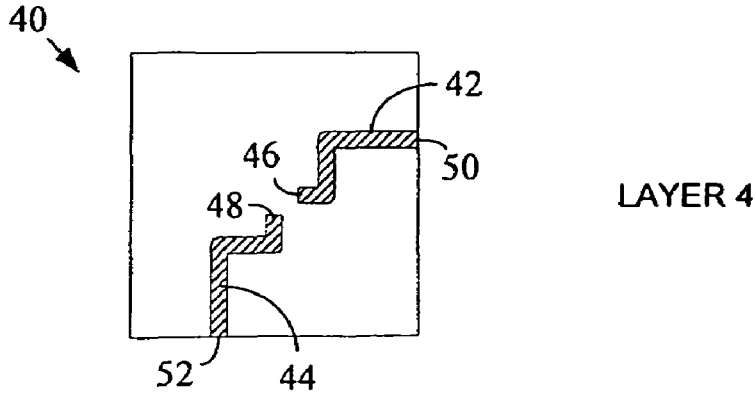

FIG. 4 is a top view illustrating the layout of the fourth metal layer 40 of the example multi-band, multi-port antenna in accordance with an embodiment of the invention. As shown, the fourth metal layer 40 includes a first microstrip feed line 42 and a second microstrip feed line 44. The first and second microstrip feed lines 42, 44 are used to facilitate slot feeding of the fed patch radiating element 22 on the second metal layer 20. The first microstrip feed line 42 has a first end 46 that is proximate to a first slot 34 in the ground plane 32 through which the first microstrip feed line 42 can couple energy to/from the patch radiating element 22. The first microstrip feed line 42 also has a second end 50 that is used as an antenna port of the antenna in the illustrated embodiment. Likewise, the second microstrip feed line 44 has a first end 48 that is proximate to a second slot 34 in the ground plane 32 through which the second microstrip feed line 44 can couple energy to/from the patch radiating element 22. The second microstrip feed line 44 also has a second end 52 which is used as an antenna port of the antenna in the illustrated embodiment. The first microstrip feed line 42 is operative for supporting a first linear polarization orientation (e.g., horizontal polarization) for the patch radiating element 22 and the second microstrip feed line 44 is operative for supporting a second linear polarization orientation for the patch radiating element 22 that is orthogonal to the first (e.g., vertical polarization). As will be described in greater detail, matching structures may be coupled to the first and second microstrip feed lines 42, 44 to provide a better match for the slot feed arrangement.

In general, only a single slot 34 is needed in the ground plane 32 for each microstrip feed line that will be slot feeding the patch radiating element 22. However, it was determined that the level of cross polarization could be reduced and an enhanced level of polarization purity could be achieved by including dummy slots in the ground plane 32 that do not have a corresponding microstrip feed line. For example, as shown in FIG. 3, the ground plane 32 has four slots 34 even though there are only two microstrip lines 42, 44 feeding the patch radiating element 22. The two slots 34 that do not have underlying microstrip lines are the dummy slots. Each dummy slot is typically parallel to a corresponding driven slot and in a similar location with respect to an opposite side of the patch being driven. In at least one embodiment, an antenna is provided that does not use dummy slots. In other embodiments, other types of coupling (i.e., other than slot coupling) may be used to feed the patch radiating element 22 (e.g., probe feed, etc.).

In general, a signal within the appropriate band applied to the antenna port 50, with no signal being applied to antenna port 52, will result in a signal being transmitted by the patch radiating element 22 with the first linear polarization orientation described above (e.g., horizontal polarization). Likewise, a signal within the appropriate band applied to the antenna port 52, with no signal being applied to antenna port 50, will result in a signal being transmitted by the patch radiating element 22 with the second linear polarization orientation described above (e.g., vertical polarization). Similarly, a signal received by the patch radiating element 22 that has the first linear polarization orientation will emerge primarily from port 50 while a signal received by the patch radiating element 22 that has the second linear polarization orientation will emerge primarily from port 52. Received signals having a combination of the first and second linear polarization orientations will emerge in part from each of the ports 50 and 52.

Figure 5:
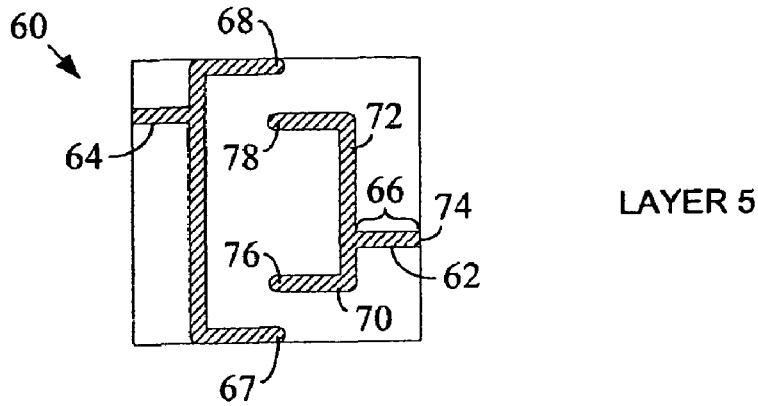

FIG. 5 is a top view illustrating the layout of the fifth metal layer 60 of the example multi-band, multi-port antenna in accordance with an embodiment of the invention. As shown, the fifth metal layer 60 includes a first microstrip structure 62 and a second microstrip structure 64. The first microstrip structure 62 is for use in feeding the first fed ring radiating element 24 for operation in the second linear polarization orientation. Similarly, the second microstrip structure 64 is for use in feeding the second fed ring radiating element 26 for operation in the second linear polarization orientation. It was determined that polarization purity and inter-port isolation could be enhanced by driving each fed ring radiating element in a balanced manner for each linear polarization orientation. Thus, in the illustrated embodiment, the first microstrip structure 62 and the second microstrip structure 64 on the fifth metal layer 60 each utilize a balanced feed approach.

As shown, the first microstrip structure 62 has a common segment 66 that branches into first and second feed segments 70, 72 at a T-junction. An end 74 of the common segment 66 acts as an antenna port 74 of the antenna. An end 76 of the first feed segment 70 is connected through an interlayer probe to a first side of the first fed ring radiating element 24. Likewise, an end 78 of the second feed segment 72 is connected through an interlayer probe to a second, opposing side of the first fed ring radiating element 24. To achieve the appropriate phase relationship for balanced operation, the electrical length of the second feed segment 72 may be made 180 degrees longer (nominally) than the electrical length of the first feed segment 70 within the corresponding frequency band. A similar configuration is used for the second microstrip structure 64 which includes ends 67, 68 that are connected through corresponding interlayer probes to opposing sides of the second fed ring radiating element 26.

Figure 6:
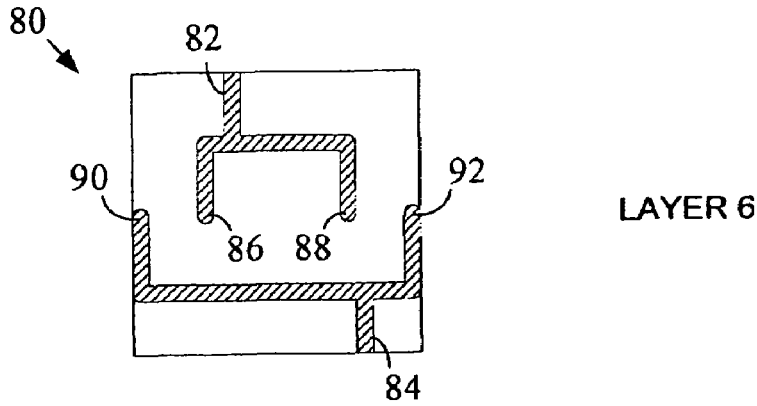

FIG. 6 is a top view illustrating the layout of the sixth metal layer 80 of the example multi-band, multi-port antenna in accordance with an embodiment of the invention. The sixth metal layer 80 is similar to the fifth metal layer 60 of FIG. 5, but is used to support operation in the first linear polarization orientation (as opposed to the second linear polarization orientation supported by the fifth metal layer 60). By separating the feed structures for dual polarization operation between two metal layers, the antenna layout may be simplified and coupling between the feeds may be reduced (although, it at least one embodiment, a single layer is used for both feed structures in a dual polarization antenna). A further reduction in coupling between the feeds of a dual polarization scheme may be achieved by situating one feed structure in a substantially orthogonal orientation with respect to the other feed structure (although, it at least one embodiment, substantially the same orientation is used for both feeds). As shown, the sixth metal layer 80 includes a third microstrip feed structure 82 and a fourth microstrip feed structure 84. The third microstrip structure 82 is for use in feeding the first fed ring radiating element 24 for operation in the first linear polarization orientation and the fourth microstrip structure 84 is for use in feeding the second fed ring radiating element 26 for operation in the first linear polarization orientation. As with the feed line structures of FIG. 5, the third microstrip structure 82 and the fourth microstrip structure 84 use a balanced feed approach. That is, for operation in the first linear polarization orientation, the first fed ring radiating element 24 and the second fed ring radiating element 26 are each fed on opposite sides by signals 180 degrees out of phase. Probes extend from end points 86, 88 of the third microstrip structure 82 to the first fed ring radiating element 24. Similarly, probes extend from end points 90, 92 of the fourth microstrip structure 84 to the second fed ring radiating element 26. Although the embodiments described above use a balanced approach to feed the ring radiators, it should be appreciated that, in other embodiments, one or more (or all) fed ring radiators may be driven at only one side for each linear polarization orientation.

Figure 7:
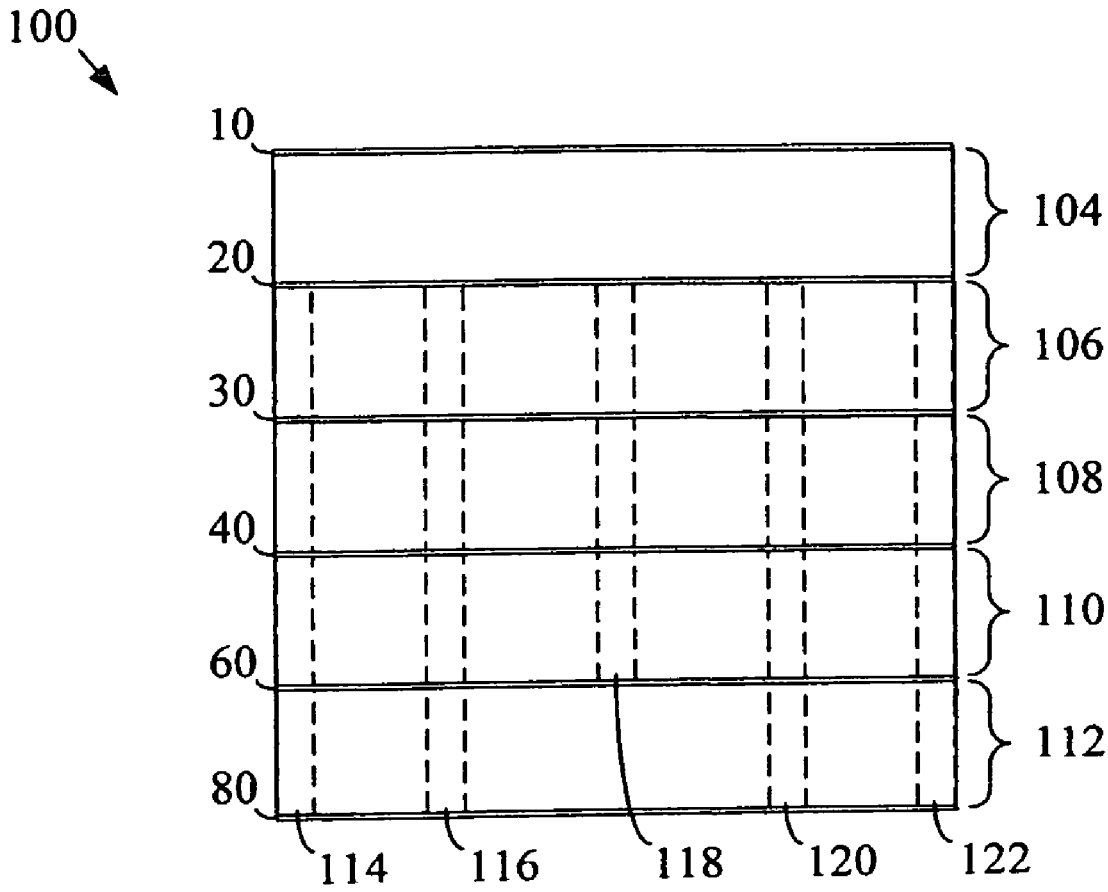
FIG. 7 is a side view of an example multi-band, multi-port antenna in accordance with an embodiment of the present invention.

FIG. 7 is a side view of an example multi-band, multi-port antenna 100 that may be formed using the metal layers of FIGS. 1-6 in accordance with an embodiment of the present invention. As shown in FIG. 7, the various metal layers 10, 20, 30,40, 60, 80 of the antenna 100 are situated one above the other with a layer of dielectric material 104, 106, 108, 110, 112 between each successive pair of metal layers. Any form of dielectric material may be used including, for example, dielectric board materials (e.g., Duroid® by Rogers Corporation, CuClad® and DiClad® by Arlon Inc., metal-clad epoxy-glass laminates, metal-clad Teflon glass laminates, Polyimide, ceramics, alumina, and/or others) and/or deposited dielectric materials. A plurality of probes 114, 116, 118, 120, 122 extend through the antenna 100 from the fifth and sixth metal layers 60, 80 having the microstrip feed structures to the second metal layer 20 having the fed radiating elements 22, 24, 26. The outer probes 114, 116, 120, 122 in FIG. 7 are each connected to corresponding end points 90, 86, 88, 92 on the third and fourth microstrip structures 82, 84 on the sixth metal layer 80 (see FIG. 6). The innermost probe 118 in FIG. 7 represents the four probes connected to the end points 67, 76, 78, 68 on the first and second microstrip structures 62, 64 on the fifth metal layer 60 (see FIG. 5). In the illustrated embodiment, all of the probes pass through the openings 36 within the ground plane 32 on the third metal layer 30 (see FIG. 3) to arrive at the first fed ring radiating element 24 and the second fed ring radiating element 26 on the second metal layer 20. The probes may be implemented in any known manner including using, for example, via connections, plated through holes, conductive posts, coaxial transmission lines, and/or others.

A multi-band, multi-port antenna in accordance with the present invention may be formed in a variety of different ways. In one approach, for example, a number of metal clad dielectric boards may be etched to achieve the desired metal layers and then laminated together to form the antenna. In another approach, an antenna may be formed using a integrated circuit type build up process. That is, metal layers and dielectric layers may be deposited one after another until the antenna is complete. Other techniques may alternatively be used. The metal layers may be formed in any known manner including, for example, by etching patterns on board materials having metallic cladding, by depositing conductive material in a desired pattern (using sputtering, electroplating, etc.) on a dielectric substrate for each layer, and/or in other ways. In at least one embodiment, the multi-band, multi-port antenna is implemented as a chip antenna.

Figure 8:
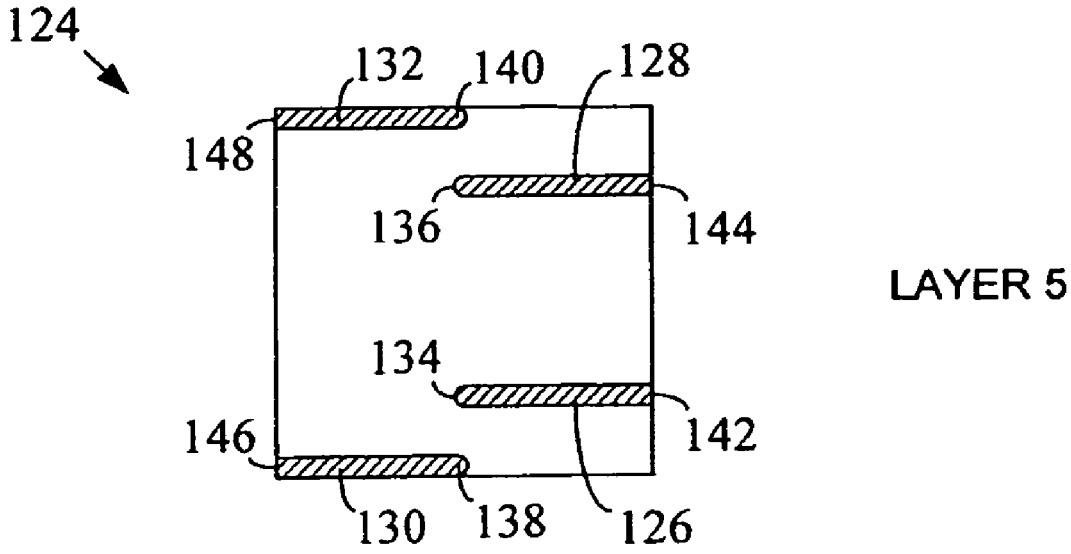
FIGS. 8 and 9 are top views illustrating modified versions of the fifth and sixth metal layers of FIGS. 5 and 6 in accordance with an embodiment of the present invention.
Figure 9:
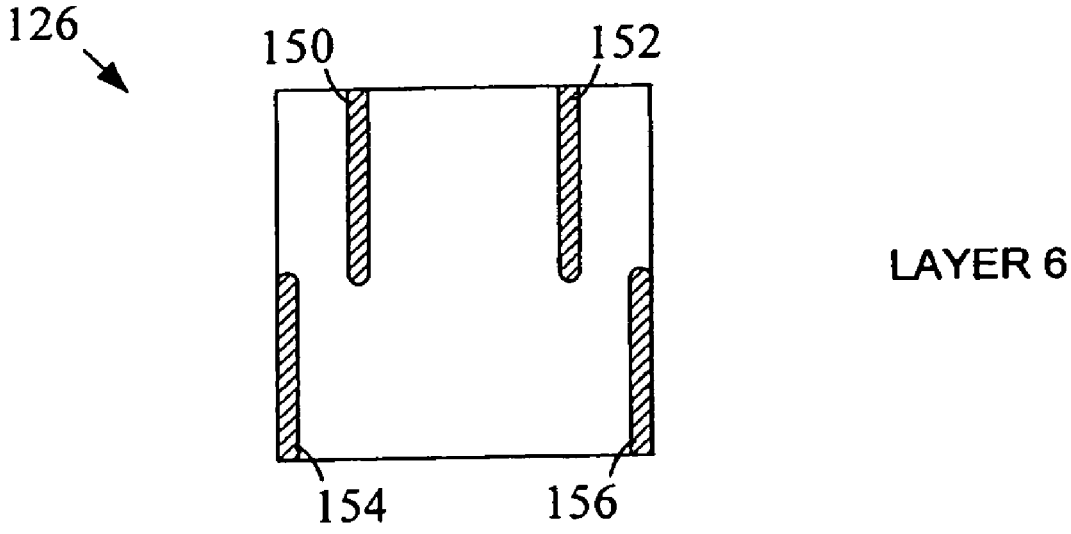

FIGS. 8 and 9 are top views illustrating modified versions of the fifth and sixth metal layers 60, 80 of FIGS. 5 and 6. With reference to FIG. 8, on the modified fifth layer 124, first and second microstrip transmission line sections 126, 128 are provided for use in feeding the first fed ring radiating element 24 for the second linear polarization orientation. Similarly, third and fourth microstrip transmission line sections 130, 132 are provided for use in feeding the second fed ring radiating element 26 for the second linear polarization orientation. The endpoints 134, 136, 138, 140 of the first, second, third, and fourth microstrip transmission line sections 126, 128, 130, 132 are connected to the corresponding portions of the first and second fed ring radiating elements 24, 26 through interlayer probes. The other ends of the first, second, third, and fourth microstrip transmission line sections 126, 128, 130, 132 serve as two balanced signal ports. That is, ends 142 and 144 of the first and second microstrip transmission line sections 126, 128, respectively, serve as a balanced signal port for the first fed ring radiating element 24 and ends 146 and 148 of the third and fourth microstrip transmission line sections 130, 132, respectively, serve as a balanced signal port for the second fed ring radiating element 26. By using balanced signal ports, one or more baluns may be dispensed with within the system. For example, a balanced signal port on an antenna may be connected directly to a balanced radio front end without an intervening balun. Referring now to FIG. 9, on the modified sixth metal layer 126, fifth and sixth microstrip transmission line sections 150, 152 are provided for use in feeding the first fed ring radiating element 24 for the first linear polarization orientation. Similarly, seventh and eighth microstrip transmission line sections 154, 156 are provided for use in feeding the second fed ring radiating element 26 for the first linear polarization orientation. As before, two balanced signal ports are formed by the ends of the fifth, sixth, seventh, and eighth microstrip transmission line sections 150, 152, 154, 156.

Figure 10:
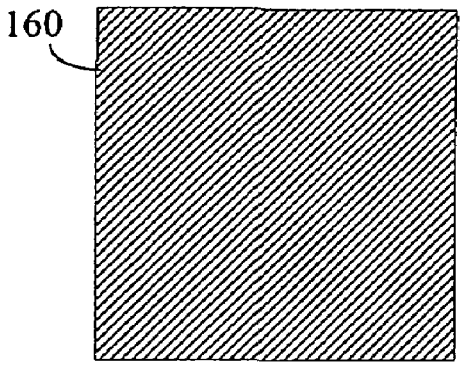
FIGS. 10, 11, and 12 are top views of metal portions for use in implementing a slot feed for a patch radiating element within a multi-band, multi-port antenna in accordance with an embodiment of the present invention.
Figure 11:
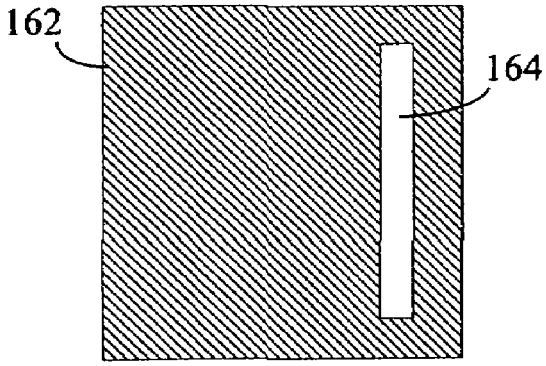
Figure 12:
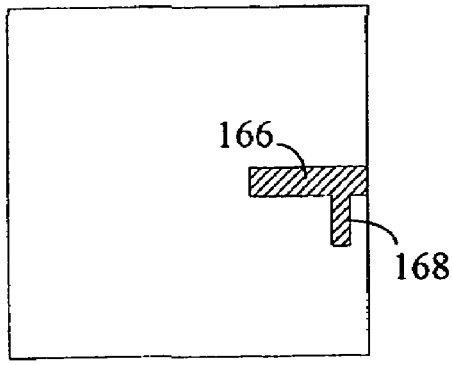

FIGS. 10, 11, and 12 are top views of metal portions for use in implementing a slot feed for a patch radiating element within a multi-band, multi-port antenna in accordance with an embodiment of the present invention. FIG. 10 illustrates a patch radiating element 160 that can be slot fed. FIG. 11 illustrates a ground plane 162 having a slot 164 for use in feeding the patch element 160. The ground plane 162 is situated below the patch element 160 with a layer of dielectric material therebetween. FIG. 12 illustrates an end portion of a microstrip feed line 166 that is used to couple energy to/from the patch radiating element 160 through the slot 164. As shown, a tuning member 168 may be coupled to the microstrip feed line 166 to appropriately match the slot coupling juncture. Various types of tuning structures may be used. To achieve wider bandwidth, for example, a T-type matching network, a π-type matching network, or a quarter-wavelength impedance transition may be used as a matching structure. In addition to the tuning structures associated with the microstrip feed line 166, the size and location of the slot 164 may be selected in a manner that enhances coupling through the slot 164.

Figure 13:
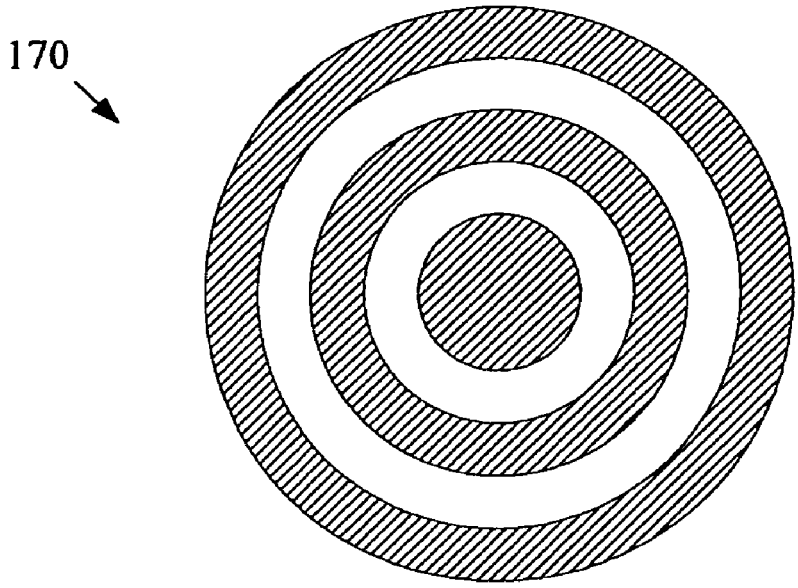
FIG. 13 is a top view illustrating a radiator configuration having round radiators for use within a multi-band, multi-port antenna in accordance with an embodiment of the present invention.
Figure 14:
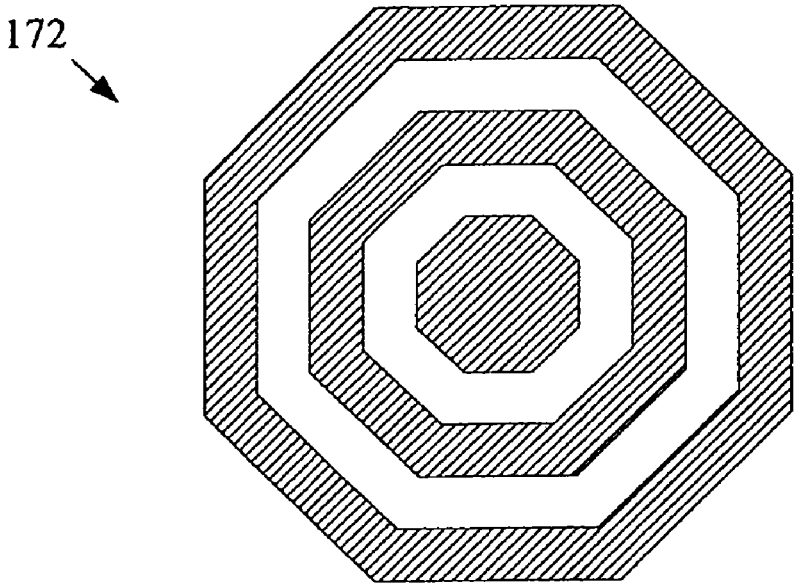
FIG. 14 is a top view illustrating a radiator configuration having octagonal radiators for use within a multi-band, multi-port antenna in accordance with an embodiment of the present invention.

In FIGS. 1 and 2, the patch radiating elements and the ring radiating elements are each square in shape. Other shapes may alternatively be used. For example, FIG. 13 illustrates a radiator configuration 170 where the various radiating elements are round in shape. FIG. 14 illustrates a radiator configuration 172 where the various radiating elements are octagonal. Other shapes are also possible. It is generally desirable, however, that the various radiating elements within an antenna all have the same general shape.

Figure 15:
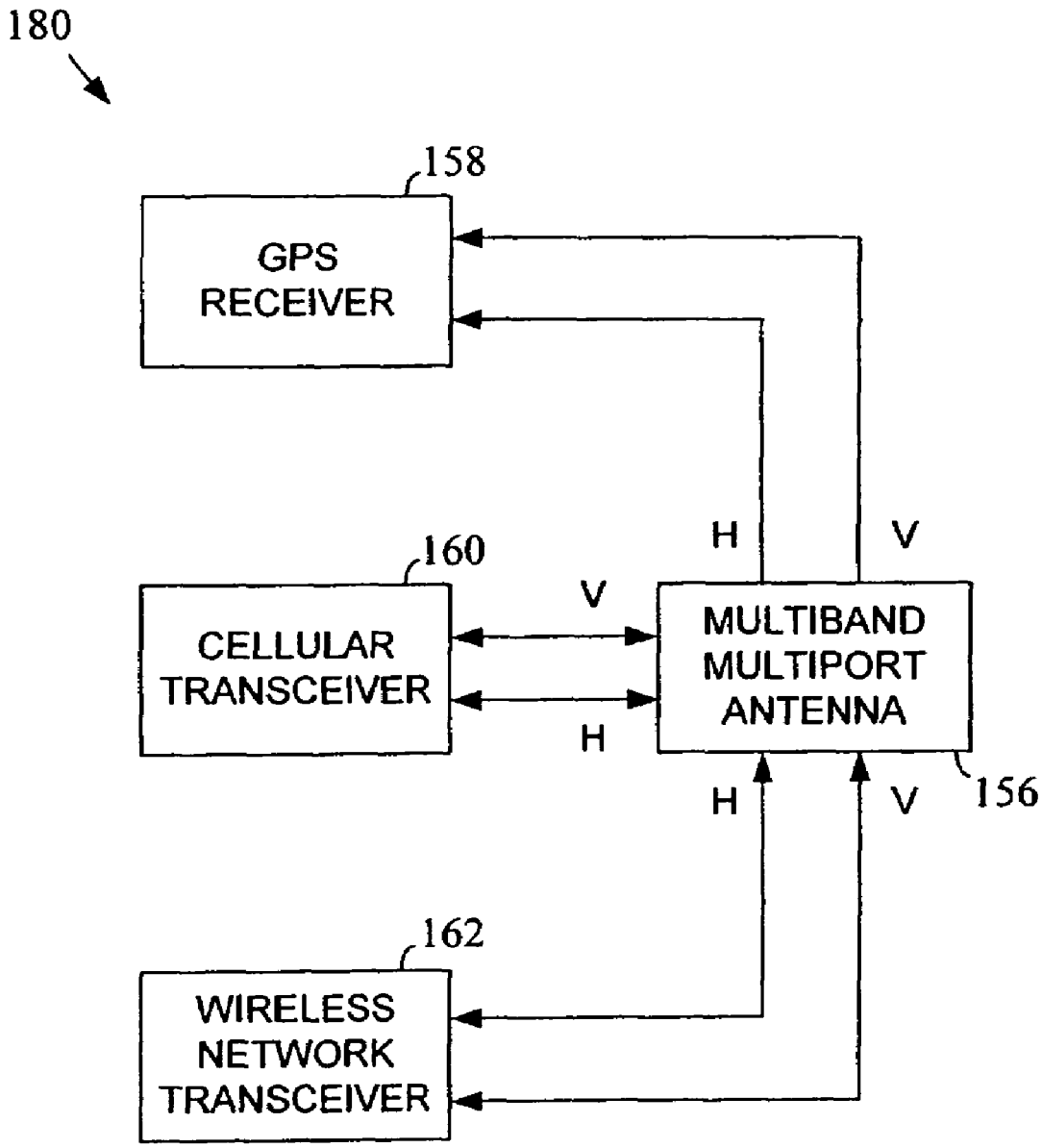
FIG. 15 is a block diagram illustrating functionality within an example wireless device in accordance with an embodiment of the present invention.

FIG. 15 is a block diagram illustrating functionality within an example wireless device 180 in accordance with an embodiment of the present invention. The wireless device 180 may include, for example, a laptop, palmtop, or tablet computer having wireless capability, a personal digital assistant (PDA) having wireless capability, a cellular telephone or other handheld wireless device, or some other device having wireless capability. As illustrated, the wireless device 180 includes: a multi-band, multi-port antenna 156, a global positioning system (GPS) receiver 158, a cellular transceiver 160, and a wireless network transceiver 162. The GPS receiver 158, the cellular transceiver 160, and the wireless network transceiver 162 are all operative within different frequency bands. The element with the highest operational frequency band will typically utilize the patch radiating element within the multi-band antenna 156. The cellular transceiver 160 may be configured in accordance with one or more cellular wireless standards (e.g., Global System For Mobile Communications (GSM), General Packet Radio Service (GPRS), Advanced Mobile Phone System (AMPS), Code Division Multiple Access (CDMA), wideband CDMA (WCDMA), CDMA 2000, and/or others). Similarly, the wireless network transceiver 162 may be configured in accordance with one or more wireless networking standards (e.g., IEEE 802.11x, Bluetooth, HIPERLAN 1, 2, Ultrawideband, HomeRF, WIMAX, and/or others).

The multi-band, multi-port antenna 156 is a three band antenna, such as the antenna described previously. As shown, the GPS receiver 158, the cellular transceiver 160, and the wireless network transceiver 162 are each coupled to two ports of the multi-band, multi-port antenna 156; one associated with horizontal polarization (labeled H) and another associated with vertical polarization (labeled V). As the GPS receiver 158 is not capable of transmitting signals, it will only receive signals from the multi-band, multi-port antenna 156. The cellular transceiver 160 and the wireless network transceiver 162 will receive signals from and deliver signals to the multi-band, multi-port antenna 156. Each of the ports of the antenna 156 may be either a single-ended port or a balanced port.

The GPS receiver 158, the cellular transceiver 160, and the wireless network transceiver 162 may each include functionality for processing both vertical polarization signals and horizontal polarization signals. For example, the cellular transceiver 160 and the wireless network transceiver 162 may each include a combiner to appropriately combine vertical polarization receive signals and horizontal polarization receive signals during receive operations. The cellular transceiver 160 and the wireless network transceiver 162 may each also include a divider to appropriately divide transmit signals into vertical and horizontal components during transmit operations. The combiner and/or divider could alternatively be implemented within the antenna itself (or as a separate structure). The GPS receiver 158 may include functionality for supporting the reception of circularly polarized signals by the multi-band, multi-port antenna 156. This may include, for example, a hybrid coupler or some other means for combining signals that are 90 degrees out of phase. Circuitry for supporting circular polarization operation may alternatively be implemented within the antenna.

The GPS receiver 158, the cellular transceiver 160, and the wireless network transceiver 162 may also (or alternatively) include functionality to limit operation to only one of the two linear polarization directions at a particular time. For example, the wireless network transceiver 162 may decide to only transmit horizontally polarized signals at a particular time. In such a case, the wireless network transceiver 162 could (e.g., using switches) deliver all transmit signals to the corresponding H port of the multi-band, multi-port antenna 156, and no signal to the V port. Likewise, the wireless network transceiver 162 may decide to only transmit vertically polarized signals and, therefore, deliver all transmit signals to the corresponding V port of the multi-band, multi-port antenna 156, and no signal to the H port. The properties of the multi-band, multi-port antenna 156 may also be taken advantage of by the cellular transceiver 160 and the wireless network transceiver 162 to support polarization diversity operation to improve communication performance. Because of the compact size of the multi-band, multi-port antenna 156, the antenna will consume very little space within the housing of a wireless device.

In the embodiment of FIG. 15, a GPS receiver 158, a cellular transceiver 160, and a wireless network transceiver 162 are coupled to a multi-band, multi-port antenna 156. It should appreciated that other types of receivers, transmitters, and/or transceivers may alternatively be coupled to a multi-band, multi-port antenna in accordance with the present invention. In at least one embodiment, a multi-band, multi-port antenna in accordance with the invention is implemented on the same chip as one or more wireless transceivers. The multi-band, multi-port antenna of the present invention may be implemented in any type of device requiring a multi-band antenna. It should be appreciated that the structures illustrated in the various figures herein may not be to scale.

The techniques and structures of the present invention may be implemented in any of a variety of different forms. For example, features of the invention may be embodied within cellular telephones and other handheld wireless communicators, personal digital assistants having wireless capability, laptop, palmtop, and tablet computers having wireless capability, pagers, satellite communicators, cameras having wireless capability, audio/video devices having wireless capability, network interface cards (NICs) and other network interface structures, integrated circuits, and/or in other formats.

It should be appreciated that the words "first," "second," "third," "fourth," etc. are used in the claims solely for the purpose of identifying and distinguishing between elements in the claims having the same base name. These words, as used in the claims, are not intended to signify a particular order or physical orientation of the claimed elements. Likewise, these words are not intended to signify a specific temporal relationship between claimed elements. In the claims, the words will typically be assigned in the order that elements are introduced, which may not be the same as the order assigned in the description (e.g., a "second layer" in the claims does not necessarily correspond to a "second layer" in the description, etc.).

In the discussion above, the multi-band, multi-port antenna is described as having a plurality of metal layers. It should be appreciated that non-metal conductive material may also be used to implement these layers in other embodiments of the invention. The broader term "conductive layer" is intended to encompass both metal layers and non-metallic conductive layers.

In the foregoing detailed description, various features of the invention are grouped together in one or more individual embodiments for the purpose of streamlining the disclosure. This method of disclosure is not to be interpreted as reflecting an intention that the claimed invention requires more features than are expressly recited in each claim. Rather, as the following claims reflect, inventive aspects may lie in less than all features of each disclosed embodiment.

Although the present invention has been described in conjunction with certain embodiments, it is to be understood that modifications and variations may be resorted to without departing from the spirit and scope of the invention as those skilled in the art readily understand. Such modifications and variations are considered to be within the purview and scope of the invention and the appended claims.

What is claimed is:

1. An antenna comprising:

a first conductive layer having:

a first patch radiating element operative within a first frequency band; and a first ring radiating element operative within a second frequency band, said second frequency band being different from said first frequency band, said first ring radiating element surrounding said first patch radiating element on said first conductive layer;

a second conductive layer having:

a second patch radiating element operative within said first frequency band; and a second ring radiating element operative within said second frequency band, said second ring radiating element surrounding said second patch radiating element on said second conductive layer;

a dielectric layer between said first conductive layer and said second conductive layer;

a third conductive layer having a ground plane with at least two slots for use in slot feeding said first patch radiating element, said third conductive layer being on an opposite side of said first conductive layer from said second conductive layer; and at least one dielectric layer between said first conductive layer and said third conductive layer;

wherein said first patch radiating element and said first ring radiating element are direct fed radiating elements and said second patch radiating element and said second ring radiating element are parasitic radiating elements; and wherein a largest dimension of said first patch radiating element in a plane of said first conductive layer is greater than a largest dimension of said second patch radiating element in a plane of said second conductive layer.

2. The antenna of claim 1, wherein:

a center point of said first patch radiating element is substantially aligned with a center point of said second patch radiating element in a direction normal to a plane of said first conductive layer; and a center point of said first ring radiating element is substantially aligned with a center point of said second ring radiating element in a direction normal to a plane of said first conductive layer.

3. The antenna of claim 1, wherein:

an outer boundary of said first patch radiating element has substantially the same shape as an outer boundary of said first ring radiating element.

4. The antenna of claim 1, wherein:

said first patch radiating element and said first ring radiating element have substantially the same center point; and said second patch radiating element and said second ring radiating element have substantially the same center point.

5. The antenna of claim 1, wherein:

portions of an outer boundary of said first patch radiating element are substantially parallel to corresponding portions of an outer boundary of said first ring radiating element;

portions of an outer boundary of said second patch radiating element are substantially parallel to corresponding portions of an outer boundary of said second ring radiating element;

portions of an inner boundary of said first ring radiating element are substantially parallel to corresponding portions of an outer boundary of said first ring radiating element; and portions of an inner boundary of said second ring radiating element are substantially parallel to corresponding portions of an outer boundary of said second ring radiating element.

6. The antenna of claim 1, wherein:

portions of an outer boundary of said first patch radiating element are substantially parallel to corresponding portions of an outer boundary of said second patch radiating element; and portions of an outer boundary of said first ring radiating element are substantially parallel to corresponding portions of an outer boundary of said second ring radiating element.

7. The antenna of claim 1, wherein:

said ground plane includes at least one opening to allow at least one probe to extend through said ground plane to act as a feed for said first ring radiating element.

8. The antenna of claim 1, further comprising:

a fourth conductive layer having a first microstrip feed line for use in feeding a first side of said first patch radiating element and a second microstrip feed line for use in feeding a second side of said first patch radiating element, said first microstrip feed line having a first end that is located in coupling relation to a first of said at least two slots in said ground plane and said second microstrip feed line having a first end that is located in coupling relation to a second of said at least two slots in said ground plane; and at least one dielectric layer between said third conductive layer and said fourth conductive layer.

9. The antenna of claim 8, wherein:

a number of slots in said ground plane is greater than a number of microstrip feed lines on said fourth conductive layer.

10. The antenna of claim 8, further comprising:

a first antenna port formed at a second end of said first microstrip feed line; and a second antenna port formed at a second end of said second microstrip feed line.

11. The antenna of claim 8, further comprising:

a fifth conductive layer having a first microstrip feed structure for use in feeding said first ring radiating element on said first conductive layer for a first linear polarization orientation;

at least one conductive probe conductively coupling said first microstrip feed structure on said fifth conductive layer to said first ring radiating element on said first conductive layer; and at least one dielectric layer between said fourth conductive layer and said fifth conductive layer.

12. The antenna of claim 11, wherein:

said at least one conductive probe extends through an opening in said ground plane on said third conductive layer.

13. The antenna of claim 11, wherein:

said first microstrip feed structure on said fifth conductive layer is configured to feed said first ring radiating element using a balanced feed approach.

14. The antenna of claim 11, further comprising:

a third antenna port formed at an end of said first microstrip feed structure.

15. The antenna of claim 11, further comprising:

a sixth conductive layer having a second microstrip feed structure for use in feeding said first ring radiating element on said first conductive layer for a second linear polarization orientation;

at least one conductive probe conductively coupling said second microstrip feed structure on said sixth conductive layer to said first ring radiating element on said first conductive layer; and at least one dielectric layer between said fourth conductive layer and said sixth conductive layer.

16. The antenna of claim 15, wherein:

said second microstrip feed structure on said sixth conductive layer is configured to feed said first ring radiating element using a balanced feed approach.

17. The antenna of claim 15, further comprising:

a fourth antenna port formed at an end of said second microstrip feed structure.

18. The antenna of claim 15, wherein:

said second microstrip feed structure on said sixth conductive layer is situated in a substantially orthogonal orientation to said first microstrip feed structure on said fifth conductive layer to reduce coupling therebetween.

19. The antenna of claim 15, wherein:

said first conductive layer further comprises a third ring radiating element that is operative within a third frequency band, said third frequency band being different from said first and second frequency bands, said third ring radiating element surrounding said first ring radiating element on said first conductive layer; and said second conductive layer further comprises a fourth ring radiating element that is operative within said third frequency band, said fourth ring radiating element surrounding said second ring radiating element on said second conductive layer.

20. The antenna of claim 19, wherein:

said fifth conductive layer includes a third microstrip feed structure for use in feeding said third ring radiating element on said first conductive layer for said first linear polarization orientation; and said sixth conductive layer includes a fourth microstrip feed structure for use in feeding said third ring radiating element on said first conductive layer for said second linear polarization orientation.

21. The antenna of claim 20, further comprising:

at least one conductive probe conductively coupling said third microstrip feed structure on said fifth conductive layer to said third ring radiating element; and at least one conductive probe conductively coupling said fourth microstrip feed structure on said sixth conductive layer to said third ring radiating element.

22. The antenna of claim 20, further comprising:

a fifth antenna port formed at an end of said third microstrip feed structure; and a sixth antenna port formed at an end of said fourth microstrip feed structure.

23. The antenna of claim 1, further comprising:

a plurality of microstrip feed lines for use in feeding radiating elements on said first conductive layer, said plurality of microstrip feed lines being located on conductive layers that are on an opposite side of said ground plane from said first conductive layer to reduce undesired electromagnetic coupling.

24. A chip antenna comprising:

a first patch radiating element to operate within a first frequency band;

a first ring radiating element to operate within a second frequency band, said second frequency band being different from said first frequency band, said ring radiating element surrounding said patch radiating element within a common plane;

a first antenna port to feed said patch radiating element for operation in a first linear polarization orientation;

a second antenna port to feed said patch radiating element for operation in a second linear polarization orientation that is orthogonal to said first linear polarization orientation;

a third antenna port to feed said ring radiating element for operation in said first linear polarization orientation;

a fourth antenna port to feed said ring radiating element for operation in said second linear polarization orientation;

a second patch radiating element to operate within said first frequency band;

a second ring radiating element to operate within said second frequency band, said second ring radiating element surrounding said second patch radiating element within a common plane, wherein said first patch radiating element and said first ring radiating element are on a first conductive layer of said chip antenna and said second patch radiating element and said second ring radiating element are on a second conductive layer of said chip antenna, wherein said second conductive layer is different from said first conductive layer;

wherein said first patch radiating element and said first ring radiating element are direct fed radiating elements and said second patch radiating element and said second ring radiating element are parasitic radiating elements;

a third ring radiating element to operate within a third frequency band that is different from said first and second frequency bands, said third ring radiating element surrounding said first ring radiating element on said first conductive layer;

a fifth antenna port to feed said third ring radiating element for operation in said first linear polarization orientation; and a sixth antenna port to feed said third ring radiating element for operation in said second linear polarization orientation.

25. The antenna of claim 24, wherein:

said first antenna port is coupled to a first microstrip feed line on a third conductive layer of said antenna; and said second antenna port is coupled to a second microstrip feed line on said third conductive layer of said antenna;

wherein said first and second microstrip feed lines are used to slot feed said first patch radiating element.

26. The antenna of claim 25, further comprising:

a fourth conductive layer located between said first conductive layer and said third conductive layer, said fourth conductive layer including a ground plane having slots through which said first and second microstrip feed lines can feed said first patch radiating element.

27. The antenna of claim 26, wherein:

said ground plane on said fourth conductive layer has dummy slots, in addition to said slots through which said first and second microstrip feed lines can slot feed said first patch radiating element, to enhance polarization purity in said antenna.

28. The antenna of claim 27, wherein:

said ground plane on said fourth conductive layer includes:

a first feed slot to couple energy between said first patch radiating element and said first microstrip feed line and a first dummy slot for said first linear polarization orientation; and a second feed slot to couple energy between said first patch radiating element and said second microstrip feed line and a second dummy slot for said second linear polarization orientation.

29. The antenna of claim 1, wherein:

said third antenna port is coupled to a first microstrip transmission structure on a fifth conductive layer of said antenna, said first microstrip transmission structure being conductively coupled to said first ring radiating element through at least one probe.

30. The antenna of claim 29, wherein:

said first microstrip transmission structure is conductively coupled to said first ring radiating element through two probes that feed opposite sides of said first ring radiating element in a balanced manner.

31. The antenna of claim 29, wherein:

said fourth antenna port is coupled to a second microstrip transmission structure on a sixth conductive layer of said antenna, said second microstrip transmission structure being conductively coupled to said first ring radiating element through at least one probe.

32. The antenna of claim 24, wherein:

said first linear polarization orientation is vertical polarization and second linear polarization orientation is horizontal polarization.

33. A communication device comprising:

a multiband, multiport antenna having:

a first conductive layer having:

a first patch radiating element operative within a first frequency band; and a first ring radiating element operative within a second frequency band, said second frequency band being different from said first frequency band, said first ring radiating element surrounding said first patch radiating element on said first conductive layer;

a second conductive layer having:

a second patch radiating element operative within said first frequency band; and a second ring radiating element operative within said second frequency band, said second ring radiating element surrounding said second patch radiating element on said second conductive layer;

a dielectric layer between said first conductive layer and said second conductive layer;

a third conductive layer having a ground plane with at least two slots for use in slot feeding said first patch radiating element, said third conductive layer being on an opposite side of said first conductive layer from said second conductive layer; and at least one dielectric layer between said first conductive layer and said third conductive layer;

wherein said first patch radiating element and said first ring radiating element are fed radiating elements and said second patch radiating element and said second ring radiating element are parasitic radiating elements; and wherein a largest dimension of said first patch radiating element in a plane of said first conductive layer is greater than a largest dimension of said second patch radiating element in a plane of said second conductive layer; and a wireless network transceiver coupled to at least one port of said multiband, multiport antenna.

34. The communication device of claim 33, wherein:

said wireless network transceiver is coupled to first and second ports of said multiband, multiport antenna, said first port to feed said patch radiating element in a first linear polarization orientation and said second port to feed said patch radiating element in a second linear polarization orientation that is orthogonal to said first linear polarization orientation.

35. The communication device of claim 34, wherein:

said first and second ports of said multiband, multiport antenna are both balanced ports and are connected to corresponding balanced ports of said wireless network transceiver, without an intervening balun.

36. The communication device of claim 33, wherein:

said wireless network transceiver includes a combiner to combine a vertically polarized receive signal and a horizontally polarized receive signal during receive operations.

37. The communication device of claim 36, wherein:

said combiner also acts as a divider to divide a transmit signal into a vertically polarized transmit signal and a horizontally polarized transmit signal during transmit operations.

38. The communication device of claim 33, wherein:

said wireless network transceiver includes circuitry for supporting polarization diversity operation.

39. The communication device of claim 33, wherein:

said first conductive layer further includes an additional ring radiating element to operate within a third frequency band, said additional ring radiating element lying in a common plane with and surrounding said patch radiating element and said first ring radiating element.

40. The communication device of claim 33, further comprising:

a global positioning system (GPS) receiver coupled to at least one port of said multiband, multiport antenna.

41. The communication device of claim 40, wherein:

said GPS receiver is coupled to third and fourth ports of said multiband, multiport antenna, wherein said GPS receiver includes circuitry for supporting reception of circularly polarized signals by said multiband, multiport antenna.

42. The communication device of claim 33, wherein:

said multiband, multiport antenna includes first feed lines, on a first conductive layer, to support operation in said first linear polarization orientation for said ring radiating element and second feed lines, on a second conductive layer, to support operation in said second linear polarization orientation for said ring radiating element, wherein said second conductive layer is different from said first conductive layer.

* * * * *